United States Patent [19]

Tolfsen

[11] Patent Number: 4,492,007

[45] Date of Patent: Jan. 8, 1985

[54] FASTENING MEANS FOR SAFETY BELTS

[75] Inventor: Ulf Tolfsen, Fredrikstad, Norway

[73] Assignee: Loyd's Industri A/S. Boks 609, Fredrikstad, Norway

[21] Appl. No.: 484,513

[22] Filed: Apr. 13, 1983

[30] Foreign Application Priority Data

Apr. 26, 1982 [NO] Norway ..... 821350

[51] Int. Cl.[3] ..... A44B 11/25

[52] U.S. Cl. ..... 24/461; 24/637

[58] Field of Search ..... 24/635, 637, 638, 641, 24/642

[56] References Cited

U.S. PATENT DOCUMENTS

| | | | |
|---|---|---|---|
| 4,136,425 | 1/1979 | Esner | 24/641 |
| 4,358,877 | 11/1982 | Burke | 24/641 |
| 4,358,879 | 11/1982 | Magyar | 24/641 |
| 4,391,024 | 7/1983 | Morinaga | 24/637 |
| 4,392,280 | 7/1983 | Gauagan | 24/637 |
| 4,394,792 | 7/1983 | Schmidt | 24/637 |

FOREIGN PATENT DOCUMENTS

| | | | |
|---|---|---|---|
| 196035 | 3/1908 | Fed. Rep. of Germany | 24/637 |

*Primary Examiner*—Victor N. Sakran
*Assistant Examiner*—Peter A. Aschenbrenner
*Attorney, Agent, or Firm*—Holman & Stern

[57] ABSTRACT

The invention comprises safety belt fastening means of the type having a locking tongue slideably engageable with a locking device. The locking device includes a locking flap releaseably engageable with the tongue, and release means for lifting and releasing the flap from engagement with the tongue; according to the invention, blocking means are provided which retain the locking flap in a raised position when the belt is unfastened, which resist initial releasing action to increase the necessary force for unfastening the belt, and which urge the locking flap into close engagement with the tongue on fastening the seat belt. The blocking means includes a blocking flap which coacts with the locking flap, and biasing means acting on the blocking and locking flaps.

17 Claims, 3 Drawing Figures

FASTENING MEANS FOR SAFETY BELTS

BACKGROUND OF THE INVENTION

The present invention relates to an improved fastening means for safety belts for cars and the like, of the type generally including an interlocking locking tongue and locking flap.

Previously known safety belt fastening means of this type generally include a locking tongue that is attached to the safety belt and is designed to engage with a locking device such as a locking flap. The locking flap, as well as other vital components of the locking means, such as expeller means and release means, are usually disposed in a locking case member, so that the entire fastening means is surrounded by a casing that is usually manufactured from a plastic material, in contrast to the remaining portions of the fastening means, which are manufactured from metal. The connection or engagement of the locking tongue and locking flap is generally released by a simple release mechanism, for example, a push-button. A serious drawback of conventional fastening means is the wear due to friction between the various metal components thereof. Vital parts, like the locking tongue, the locking flap, and the locking case are exposed to friction and consequently to wear as a result of repeated engagements of the locking tongue and locking flap.

Such wear will gradually result in an impairment of functional security. To comply with prevailing international requirements as to functional security of the fastening means, lubricants are today used to reduce the friction between components of the fastening means and, thus, the wear. Lubricants, however, have the disadvantage that they may rub off on the user. Also, lubricants bind dust and the like, so that the lubricant no longer has the expected effect but, on the contrary, contributes to increased friction.

Lately, regulations have been formulated regarding the maximum force permitted for releasing safety belt locking mechanisms. The critical values of said force are at present at maximum 6 kp and minimum 1 kp. In Applicant's Norwegian Patent NO-PS No. 138 431, published May 29, 1978, a fastening means is described that is essentially characterized by the fact that in the push-button release mechanism, the extension of the push-button comprises a cam surface which is directed away from a locking tongue and which provides a sloping curve that turns into an upright, nose-like portion, the lower end of which is provided with a notch or the like into which the locking flap slides with one end and is locked. Common to this fastening means and other conventional fastening means is that the force used to release the fastening means in a non-loaded state is close to the above-mentioned minimum force of 1 kp. The force used in the start phase of the opening procedure, however, often will be below this minimum value, and may easily result in unintentional opening of the fastening means on light contact with the push-button.

An object of the present invention is to provide a fastening means for safety belts for cars that does not have the above disadvantages.

Another object of the invention is to provide a light and inexpensive construction of a fastening means, that is also resistant to forces that tend to break the fastening means. Such forces would, as known, occur in connection with heavy loads exerted during car crashes and similar events.

SUMMARY OF THE INVENTION

The invention comprises safety belt fastening means of the type having a locking tongue slideably engageable with a locking device. The locking device includes a locking flap releaseably engageable with the tongue, and release means for lifting and releasing the flap from engagement with the tongue; according to the invention, blocking means are provided which retain the locking flap in a raised position when the belt is unfastened, which resist initial releasing action to increase the necessary force for unfastening the belt, and which urge the locking flap into close engagement with the tongue on fastening the seat belt. The blocking means includes a blocking flap which coacts with the locking flap, and biasing means acting on the blocking and locking flaps. A single biasing means is illustrated; however, two or more biasing means may be utilized to accomplish the stated function. Preferably, the locking device includes expeller means for expelling the locking tongue after release from the locking flap. The locking flap preferably includes means for making a direct connection between the locking flap and a vehicle mounting element.

The invention is described in detail with reference to the attached drawing, illustrating one embodiment of the invention, in which.

DETAILED DESCRIPTION OF THE DRAWINGS

Figure 1:
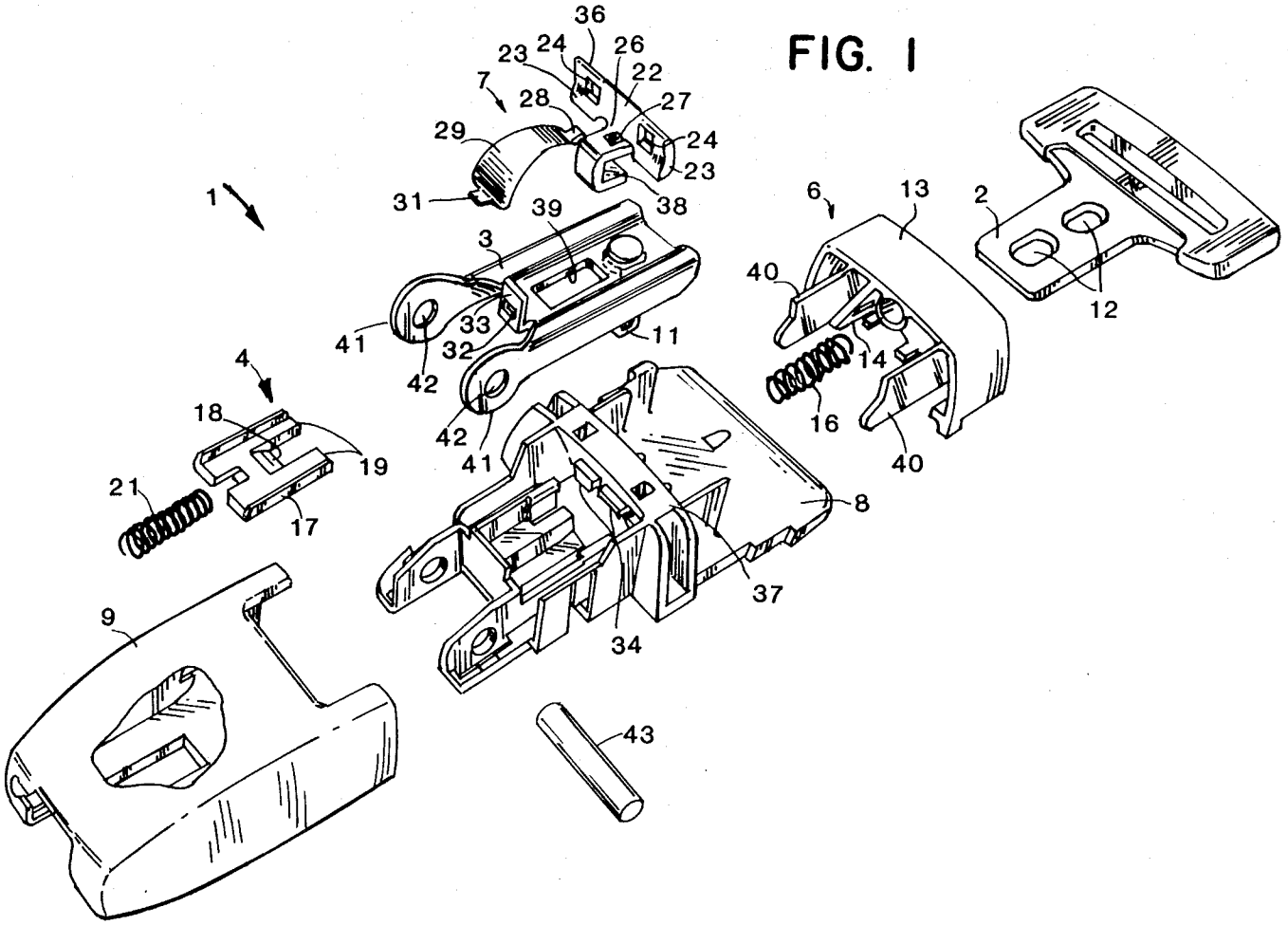
FIG. 1 is an exploded view of a safety belt fastening means according to the invention.

With particular reference to FIG. 1, a seat belt fastening means according to the invention is generally indicated at 1. The fastening means 1 includes a locking tongue 2; locking means including a locking flap 3; expeller means generally indicated at 4; release means generally indicated at 6; and blocking means generally indicated at 7. The fastening means 1 further includes a frame 8 for the locking flap 3, expeller means 4, release means 6, and blocking means 7; and a casing 9 for the locking means and frame 8.

The locking flap 3 includes locking tongue engaging means comprising a projection 11 for engaging apertures 12 of the tongue 2, and reposes in the rear portion of frame 8. The release means 6 is of the push-button type, and includes a push-button 13 resting on the forward portion of frame 8, and having raising cam elements 14 on both sides of push-button 13 for raising locking flap 3 out of engagement with locking tongue 2 when push-button 13 is pushed toward the interior of the frame 8. The release means 6 further includes a biasing spring 16 for returning the push-button 13 to its normal position.

The expeller means comprises an expeller 17 having a nose portion 18 and leg portions 19. The expeller is disposed in the frame 8 beneath the locking flap 3 for horizontal movement, and is biased by spring 21 toward the forward portion of the frame 8 to act against and expel the tongue 2 from the locking means when the raising cam elements 14 of the push-button 13 lift the locking flap 3 out of engagement with the tongue 2.

The blocking means 7 of the invention includes a blocking flap 22 having an upper lugged portion 23 with apertures 24, and a central portion 26 with an aperture 27 for receiving a tab 28 at one end of a biasing spring 29; a tab 31 at the opposite end of spring 29 engages with a slot 32 in a projection 33 on the rear portion of locking flap 3. The blocking flap 22 is pivotally supported in frame 8 on pins 34, with a supporting edge 36 beneath a bridge 37 of the frame 8. The blocking flap 22 further includes a lower U-shaped portion 38 which extends through an opening 39 in the locking flap 3 and retains the tongue 2 and the locking flap 3 together when the fastening means is engaged. U-shaped portion 38 is released from tongue 2 and locking flap 3 by the action of cornered lugs 40 on each side of push-button 13; as best seen in FIGS. 2 and 3, the sliding action of push-button 13, in addition to lifting locking flap 3, causes the cornered lugs to bear against the upper lugged portion 23 of the blocking flap 22, and pivot it away from locking flap 3 to partially release the flap 3.

In a preferred embodiment of the invention, the locking flap 3 includes rear lugs 41 having holes 42 for receiving a securing bolt 43 for making a direct hinged connection between the free end of a safety belt or vehicle mounting means and the locking flap 3, for attaching the locking means to a vehicle.

Figure 2:
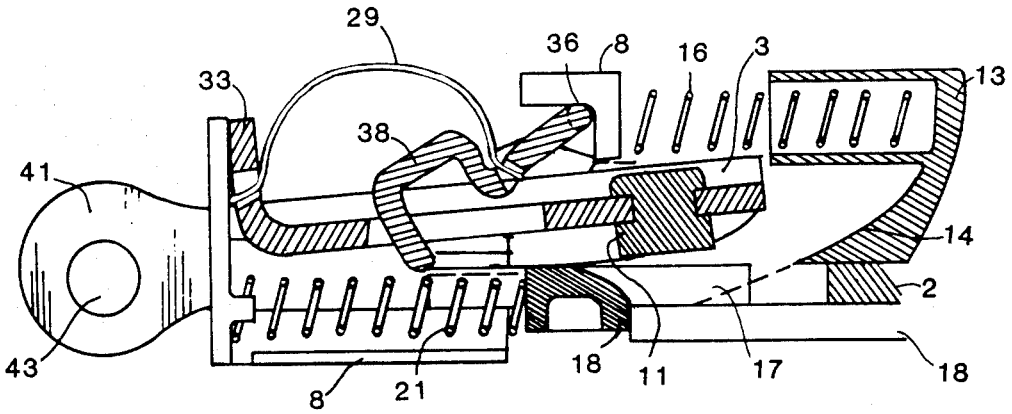
FIG. 2 is a vertical cross-section of the assembled fastening means of FIG. 1 in an open position.
Figure 3:
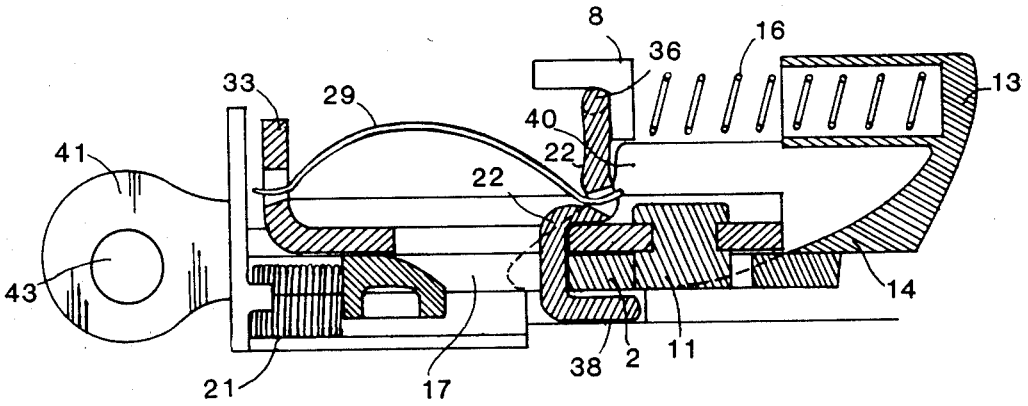
FIG. 3 is a vertical cross-section of the assembled fastening means of FIG. 1 in a closed position.

FIG. 2 shows the assembled fastening means of the invention in an open position. The expeller 17 that slides on the bottom of the interior frame 8 is shown in its forward position with the expeller spring 21 in a relaxed condition. The locking flap 3 is in its upper, or open, position and is held in this raised position by the tensional force exerted by the locking spring 29 engaging with the locking flap projection 33 and urging against the blocking flap 22. The horizontal force component provided is exerted closely beneath the supporting edge 36, and this results in a very limited downward force applied against the expeller 17, against which the blocking flap 22 is resting. Consequently, the blocking flap 22 will, in its open position, only have insignificant contact with the expeller 17. Friction between the blocking flap 22 and the expeller 17, and between the expeller 17 and the interior frame 8, which may consist of a plastic material, will thus be small and controllable. There will, thus, be minimum wear of the parts. The use of the locking spring 29 between the locking flap 3 and blocking flap 22, furthermore, causes the locking flap 3 to be held in a raised position when open without its touching the expeller 17, or other parts. In this manner, friction is eliminated and so is any wear. In conventional fastening means, the expeller will normally keep the locking flap in a raised position by the aid of cam members and the like; such direct contact results in friction and wear.

The locking tongue 2 to be inserted into the fastening means urges expeller 17 inward until blocking flap 22 is free to fall or be urged down in front of the nose portion 18 of the expeller 17, between the expeller legs 19. The lugs 23 of blocking flap 22 will simultaneously urge locking flap 3 down, and the fastening means is then in a locked position, as shown in FIG. 3. U-shaped portion 38 of blocking flap 22 now extends beneath the locking tongue 2, and secures tongue 2 to locking flap 3. The locking tongue 2 is made of steel and will not, as in conventional fastening means, slide into contact with a locking case or other steel parts. In the present case there will be no friction worth mentioning and, thus, a minimum of wear, and this is achieved without any use of lubricants.

For opening the fastening means, the push-button 13 is depressed. Blocking flap 22 is, thus, removed from its engagement because the cornered lugs 40 on each side of push-button 13 in the course of a very short movement will abut against the lugs 23 of blocking flap 22, and the two raising cams 14 of push-button 13 will also raise locking flap 3 from its engagement with the locking tongue 2. The blocking flap 3 is kept in a raised position until the opening movement has been completed. Expeller 17 will then expel locking tongue 2 and push-button 13 is returned to its open position by push-button spring 16. The fastening means is now in the open position shown in FIG. 2.

When opening the fastening means according to the present invention the force used to depress push-button 13 will be relatively high in the beginning, will rapidly decrease, and will increase again to a certain degree at the end. In this manner a certain protection against unintentional opening, as well as blocking in a half-locked position is achieved. The characteristic force requirement for opening is due to the fact that force must be used at first to remove and swing off the blocking flap 22. Then locking flap 3 is raised by use of relatively low force. The increase of force towards the end is partly due to spring tension against the push-button 13, partly due to the fact that locking flap 3 is definitely removed from locking tongue 2, and also, to a higher extent, due to the fact that the raising cams 14 of the push-button 13 have a more acute angle towards their ends.

Another advantage of the present fastening means is that changing from an open to a locked position is achieved very rapidly and securely. This is due to the fact that the forward acting forces of locking spring 29 are rapidly released when blocking flap 22 is no longer in contact with the expeller 17. Blocking flap 22 will simultaneously urge locking flap 3 down and thereby overcome the rasing force that locking spring 29 also exerts on locking flap 3. The blocking means of the invention may also be used in conjunction with fastening means which do not include expeller means; in this event, the tendency of blocking spring 29 to urge the blocking flap 22 downward is counter-acted by another element when the locking flap 3 is in the open or raised position.

With the novel blocking flap 22 according to the invention, a more dependable connection than in the prior art is achieved between locking tongue 2 and locking flap 3, because the blocking flap 22 positively holds these two parts together in a locked position. Also, the blocking flap 22 has rendered it possible to eliminate the so-called "locking case" of steel in conventional fastening means. Thus, not only has a heavy and expensive part been eliminated from said fastening means, but, at the same time, a part has been eliminated that contributed essentially to the friction between the vital parts of the fastening means and, thus, to the wear of said parts. In the fastening means according to the present invention, the movable parts sliding against each other may to a high degree consist of alternately steel and plastic resulting in the elimination of friction as well as wear.

An essential advantage of the present fastening means is the special construction of the locking flap 3 proper which permits a direct hinged connection with a mounting member, e.g., a fixing strap or similar mounting member in a vehicle. The utilization of the fixing bolt 43, permist elimination of an additional hinge connection that would otherwise have been necessary to absorb bending forces and similar forces occurring in a car crash or similar impacts.

A further advantage of the fastening means described above is that it is mounted without any use of nails, screws, or other similar fasteners. The metal parts of the fastening means are preferably provided with raised structures that are in contact with the inside of the casing, so that said fastening means is very difficult to destroy due to high loads from outside.

What I claim is:

1. In a fastening means for fastening a safety belt of the type wherein a locking tongue attached to one free end of the belt is slidably engagable with locking means attached to the other free end of the belt or to a vehicle mounting element, and wherein said locking means includes a frame for supporting a locking flap releasably engageable with said tongue, and release means for lifting and releasing said flap from engagement with said tongue; the improvement comprising blocking means for urging said locking flap from an open, raised position to a closed, lowered position in engagement with said locking tongue in response to sliding insertion of said locking tongue into said locking means, for retaining said locking flap in the open, raised position when the seat belt is unfastened, and for resisting initial action of said release means so that the force required to initiate release of the locking tongue is greater than that required to complete the release, said blocking means including a blocking flap pivotally associated with said frame, and biasing means for urging said locking flap into an open, raised position, and for urging said blocking flap against said locking flap to lower it into engagement with said locking tongue when said locking tongue is inserted into said locking means.

2. The invention of claim 1, wherein the locking means further includes expeller means for expelling the released tongue from the frame, said expeller means being disposed in the frame so that the action of the biasing means on the blocking flap is counteracted by the expeller means when the belt is unfastened, and so that insertion of said locking tongue displaces said expeller means to permit the locking flap to be urged into a closed, lowered position in engagement with said locking tongue.

3. The invention of claim 1, wherein said blocking means further functions to retain said locking flap and locking tongue in engagement when the seat belt is fastened.

4. The invention of claim 3, wherein the blocking flap includes a clamping portion for clamping said locking flap and said locking tongue together when the belt is fastened.

5. The invention of claim 4, wherein said clamping portion is a U-shaped portion, and wherein one arm of the U extends beneath the locking tongue when the belt is fastened.

6. The invention of claim 1, wherein said blocking flap includes an upper lugged portion supported by said frame, a central portion, and a lower blocking portion adapted to retain said locking flap and said locking tongue in juxtaposed locking engagement when the belt is fastened; and wherein said biasing means comprises a locking spring engaged at one end thereof with said locking flap, and at the other end thereof with said central portion of said blocking flap.

7. The invention of claim 6, wherein the action of said spring on said blocking flap to urge the locking flap into the lowered, closed position is counteracted by the disposition of expeller means for expelling said locking tongue when the belt is unfastened.

8. The invention of claim 7, wherein the horizontal force component of the biasing spring is exerted directly below the supported edge of the upper, lugged portion of the blocking flap, so that the necessary counteracting force of the expeller means is sufficiently low to substantially prevent friction between the blocking flap and expeller means and between the expeller means and frame.

9. The invention of claim 7, wherein the blocking portion of the blocking flap is U-shaped.

10. The invention of claim 7, wherein said biasing spring acts on said blocking flap to urge the upper, lugged portion thereof against said locking flap.

11. The invention of claim 1, wherein said release means comprises cam elements for raising said locking flap out of engagement with said locking tongue, and lug elements for engaging and pivoting said blocking flap away from said locking flap.

12. The invention of claim 11, wherein said release means is adapted for horizontal sliding engagement with said blocking means and said locking flap.

13. The invention of claim 12, wherein said release means includes biasing means for biasing said cam and lug elements out of engagement with said blocking means and locking flap, after said locking flap is released.

14. The invention of claim 11, wherein said lug elements engage said blocking flap before said cam elements engage said locking flap, so that a higher initial force is required to pivot said blocking flap, and a lower subsequent force is required to raise said locking flap and release said locking tongue.

15. The invention of claim 1, wherein the locking flap is directly secured to vehicle mounting means for attaching the locking means to the vehicle.

16. The invention of claim 1, wherein the elements of said fastening means form an entirely metal linkage when the seat belt is fastened.

17. The invention of claim 15, wherein the locking flap includes a pair of apertured lugs in the rearward portion for receiving a fixing bolt adapted for making a direct hinged connection with the vehicle mounting means.

* * * * *